United States Patent [19]

Wallstén

[11] 4,102,299

[45] Jul. 25, 1978

[54] APPARATUS FOR APPLYING A COATING COMPOSITION ONTO A MOVING WEB

[75] Inventor: Hans Ivar Wallstén, Lausanne, Switzerland

[73] Assignee: Inventing S.A., Lausanne, Switzerland

[21] Appl. No.: 622,493

[22] Filed: Oct. 15, 1975

[30] Foreign Application Priority Data

Oct. 16, 1974 [SE] Sweden ..... 7413043

[51] Int. Cl.[2] ..... B05C 5/02; B05C 11/04

[52] U.S. Cl. ..... 118/50; 118/124; 118/411; 118/603

[58] Field of Search ..... 118/410, 411, 50, 50.1, 118/63, 123, 124, 8, 603, 610

[56] References Cited

U.S. PATENT DOCUMENTS

| | | | |
|---|---|---|---|
| 2,784,697 | 3/1957 | Uhleen | 118/411 |
| 3,190,261 | 6/1965 | Ziffer | 118/8 |
| 3,196,832 | 7/1965 | Zin | 118/410 X |
| 3,274,307 | 9/1966 | Bergstein et al. | 118/603 X |
| 3,461,837 | 8/1969 | Dreher | 118/50 |
| 3,470,848 | 10/1969 | Dreher | 118/429 X |
| 3,474,757 | 10/1969 | Dreher | 118/411 |
| 3,486,482 | 12/1969 | Hunger | 118/126 X |
| 3,854,441 | 12/1974 | Park | 118/410 X |
| 3,937,177 | 2/1976 | Lloyd | 118/50 |

*Primary Examiner*—John P. McIntosh
*Attorney, Agent, or Firm*—Louis Weinstein

[57] ABSTRACT

A method and apparatus for applying a coating composition onto a moving web especially a paper web, in which an excess of said coating composition is applied to said web. The web thereafter passes smoothing means to uniformly regulate the final thickness of the coating and simultaneously to remove the excess coating composition. This smoothing operation is performed under an adjustable partial vacuum. The removed excess coating composition is recirculated without being mixed with the coating composition within the application area and is mixed with fresh coating composition before reuse within the process.

13 Claims, 19 Drawing Figures

APPARATUS FOR APPLYING A COATING COMPOSITION ONTO A MOVING WEB

BACKGROUND OF THE INVENTION

1. Field of invention

This invention pertains to web coating systems and more particularly to a coating system for applying a coating composition onto a paper web.

2. Description of the prior art

According to a known method a moving web is treated with liquid by passing the web tightly over an opening in a container connected to a liquid supply and to a vacuum source so that the vacuum is maintained in said container and the liquid is drawn by said vacuum up over said opening, thus reaching the web. Attempts have also been made to arrange a further opening, which could be divided into one or more rows of holes, in this known container and furthermore a horizontal rod has been placed longitudinally across said row of holes. This arrangement has been used to remove excess liquid from the web when passing said rod due to the vacuum in said container. However this removed excess liquid is recirculated to the lower part of the container containing fresh liquid to be supplied to the web.

This known device may be used for treating paper webs with water, surface size in the form of a starch solution and other liquids having low viscosity. The advantage of this known system is that it is compact and that if the web breaks because wetting is performed under vacuum, only a small quantity of the liquid will be spilled.

In producing coated paper for use as printing paper, at least one side of the paper web is coated with a suspension containing pigments, for example clay suspended in water. Those suspensions for coating compositions generally also contain a number of chemical additives, such as binders, dispersing agents etc. The water content in such coating compositions is partly absorbed during the coating of the web and simultaneously a screen cake of pigment builds up on the surface of the web. After the coating operation the web is passed through suitable drying means so that the absorbed water is caused to evaporate either entirely or partially.

This necessary evaporation step not only affects the ultimate costs of the finish product due to the very nature of the coating process, but also requires that the coating operation be performed with a coating composition which is as dry as possible. It has recently been established that blade-coating systems are highly recommendable for coating compositions having a high dryness content. Such blade-coating systems comprises a thin, flexible blade arranged to press the web against a backing surface, such as a rotating roller, thereby smoothing the applied coating composition evenly over the web and at the same time removing the excess coating composition from the web. These known techniques also have the advantage of enabling very high operating speeds to be used for such systems because, due to the high dryness content of the composition, the relatively minor quantity of water can be evaporated without using large drying equipment. It has been found that coating compositions with dryness contents of between 55–60 percent by weight of dry substance could be used in such blade coating systems, but even higher dryness contents are mainly used.

It might perhaps be thought that the above described means with vacuum-suction of liquid could be used for coating paper, for instance, with coating compositions having high dryness content. However, it has been found that such is not the case. The reason is that the smoothing arrangement in this known process in the form of a horizontal rod, is not suitable as a smoothing and regulating member.

It has also been established that this known arrangement has other drawbacks. When coating with coating compositions having dryness contents above 40–50%, considerable problems arise after only a few moments running. These problems appear to have a tendency to increase the higher the dryness content of the coating composition applied. Thus great variations regarding the final thickness of the coating occur during the coating process. Another problem is that uncoated spots are formed from time to time on the web. Yet another problem is formation of streaks in the coating layer.

These problems have proved to be of such a nature that production of coated paper on an industrial scale using this known method is impossible with coating composition having dryness contents above about 50%, and are particularly serious at web speeds of 150–200 m/min. and more.

A closer study of the problem of variations in the coating thickness indicates that these are probably caused by the removed excess coating composition being obviously drier than the fresh coating composition, since water from said composition is absorbed by the paper. Since the thickened excess coating composition recirculated to the bottom part of the container, will not be completely mixed with the fresh coating composition supplied to the same container, which is not so dry, said variations in coating thickness are obtained. The problem of uncoated spots in the paper web is probably due to foam which, as is known, is easily formed in the moving coating composition. The foam will be collected in the container and is removed from said container from time to time with the coating composition applied to the paper web. The problem of streaks is caused by lumps of fiber, agglomerate of pigment and so on which are formed by said rod scraping against the paper web and thus are collected in the lower part of the container, to be fed out from the container from time to time with the coating composition. Particles of fiber and pigment or the like therefore easily catch under the rod and produce streaks in the coating making the coated paper unusable.

SUMMARY OF THE INVENTION

In accordance with the teachings of the present invention there is provided a coating method and apparatus having a wider operating range than said conventional device. In addition, generally higher coat weights may be applied to the web than with conventional equipment, and coating materials having a wider range of solid contents of pigment may be used. By being able to use coating materials having varying characteristics and properties and by being able to selectively change the operating condition of the coater, a wider range of high quality coated products can be produced. Generally the method employed with applicant's coating system comprises the steps of applying an amount of coating composition in excess of that required for the final coating to the surface of the web;

passing the coated web over smoothing means to uniformly regulate the final thickness of the coating and simultaneously to remove the excess coating composition;

thereby regulating the thickness of the final coating by means of an adjustable partial vacuum applied at said smoothing means; and recirculating said removed excess coating composition separately without being mixed with the coating composition within the application area to be mixed with fresh coating composition before being reused in the process.

As compared with the above known coating apparatus using a rod as a doctoring mechanism the use of the method and apparatus of the present invention invention results in the ability to provide a wide variety of high quality coated papers capable of being produced under selected operating conditions of the apparatus.

DETAILED DESCRIPTION OF THE INVENTION

Figure 1:
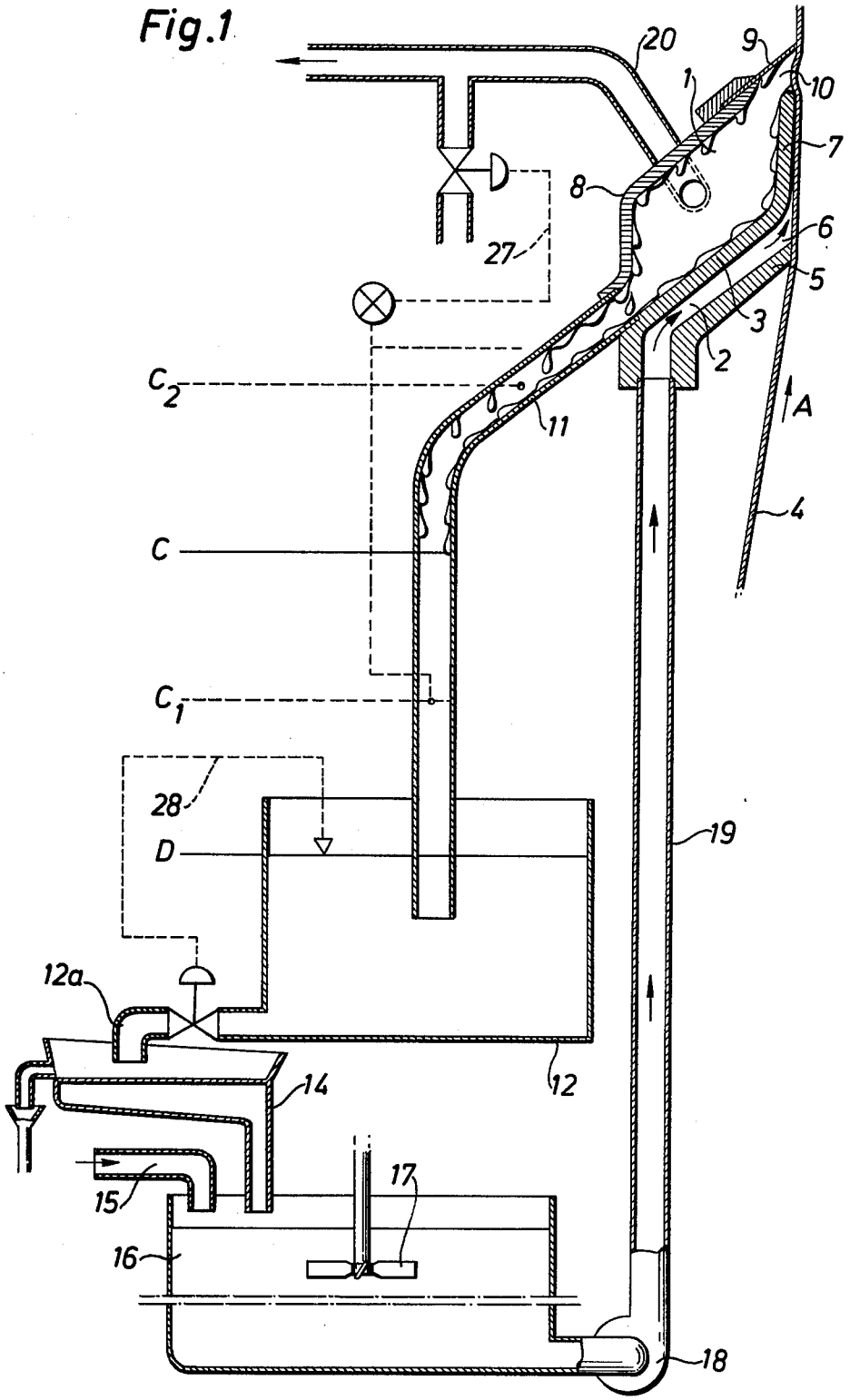
FIG. 1 is a principal view of a first embodiment of the improved coating system of the present invention.

The apparatus shown in FIG. 1 consists of a container or first chamber 1 and a second chamber or channel 2, said spaces 1 and 2 being completely separated from each other by a partition wall 3, for instance. The container 1 has a substantially vertical wall section 7. A dispensing slot 6 is formed between the lower wall 5 of the chamber 2 and the wall section 7, through which slot 6 an excess of coating composition is applied under pressure to a paper web 4 being moved in the direction of arrow A. The vertical wall section 7 and the wall section 5 are located substantially in the same plane. A slot 10 is formed between the upper edge of wall 7 and an oblique wall section 8 in which a flexible blade 9 is arranged. The blade 9 forms an acute angle with the direction of movement of the web 4. An outlet pipe 11 extends from the lower part of the container 1 to a container 12 intended to collect the removed excess coating composition. The container 12 is provided with an outlet part **12*a* opening arranged over a screen or cleaning means 14. Below the screen 14 a storage container 16 is arranged containing a mixture of fresh, uncirculated coating composition and cleaned, recirculated coating composition. The fresh coating composition is supplied to the storage container through an inlet 15. A stirring means 17 is provided in the container 16. An outlet pipe 19, provided with a pump 18 and connected to the chamber 2, leads from the container 16. The container 1 is connected to a vacuum system by a conduit 20. End stops 6*a* and 10*a* may be provided in slots 6 and 10**, respectively, to limit the width of the coating applied to the web.

The coating composition, consisting of a controlled mixture of fresh and recirculated material, is applied onto the paper web 4 via pipe 19, chamber 2 and dispensing slot 6 by means of pump 18 and a suitable regulating system. During its movement upwards the paper web 4 is somewhat stretched and preferably bent slightly over the somewhat rounded edge at the bottom of the wall 5. Both the dispensing slot 6 and the suction slot 10 are laterally limited by stops, preferably adjustable, not shown in the drawings. The width of the slot 6 is preferably chosen slightly narrower than the width of the paper web 4 so that a narrow zone along each edge of the paper web remains uncoated. The quality of coating composition applied to the paper web 4 under pressure and in excess is regulated by suitable means. By excess is meant here that the quantity of coating composition supplied through the slot 6 exceeds the quantity of composition remaining on the paper web after the coating operation.

Figure 2:
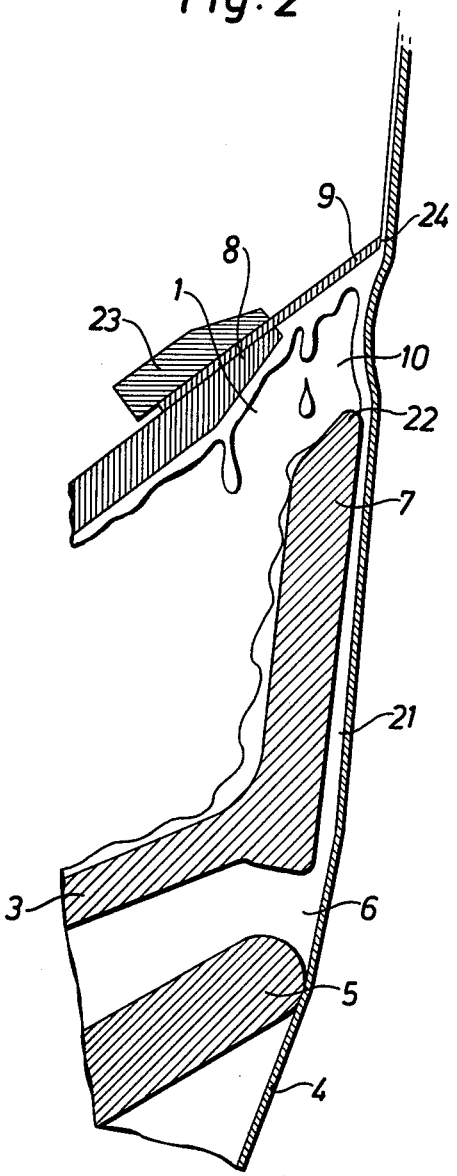
FIG. 2 is an enlarged view of the means shown in FIG. 1.

FIG. 2 shows in an enlarged view how application and removal of the coating composition is performed. Above the slot 6 between the wall 7 and paper web 4 a thin pocket 21 of coating composition is formed. This pocket is generally somewhat narrower towards its top. The coating composition in the pocket 21 acts as a lubricant so that the paper web 4 slides easily over the surface formed by the wall 7. At the same time the film of coating composition between the paper web 4 and the lower edge of the suction slot 10 forms a liquid seal against the partial vacuum prevailing in the chamber 1. Since the upper edge 22 of the wall 7 is turned slightly inwards, there is no chance of the composition being unnecessarily scraped off against this edge. The blade 9 is in principle a continuation of the oblique wall section 8. In the embodiment according to FIG. 2 the blade 9 is clamped between the wall section 8 and a holder 23. This arrangement enables the extent to which the blade protrudes in relation to the paper web 4 to be easily adjusted as desired. Furthermore, the blade can easily be replaced, which is an advantage from the wear point of view and also permits the use of blades of various thicknesses. The blade is also suitably provided with a bevel 24 on the edge being in contact with the web 4.

As evident from FIG. 2, the paper web 4 has a tendency to curve in slightly as it passes the upper suction slot 10 due to the partial vacuum prevailing in the chamber 1. The size of the curve is also to a certain extent dependent upon the paper tension and upon the stiffness of the paper web. The distance between the lower edge 22 of the suction slot and the upper edge 24 is also of significance for the size of the curve and if the coating means is to be used for a wide range of paper and cardboard qualities it may be of value if the distance between the edges 22 and 24 of the slots can be varied according to the quality desired.

As already mentioned, the excess coating composition is removed by the edge of the blade. It has been found that the quantity of removed excess coating composition depends partly on the partial vacuum prevailing in the chamber 1. In general, for paper of the same quality, the higher the partial vacuum the greater will be the quantity of removed excess coating composition i.e. for a certain constant quantity of coating composition applied on the paper the coating quantity decreases on the paper coated with an increased vacuum condition. Under otherwise equivalent conditions, such as paper quality, web speed, paper tension, nature of coating composition, quantity of coating composition applied, angle of blade and thickness of the blade, it has been possible to establish very satisfactory reproducibility between the quantity of coating applied and the partial vacuum. It has been found that by varying the the partial vacuum it is possible to vary the coating thickness within wide limits as well as being able to adjust the coating thickness and correct it so that the variations in thickness during the coating process can be kept within extremely narrow limits.

It has thus been found possible, using components known per se, in a simple manner to arrange a measuring and control system for the coating thickness. One such measuring and control system consists, for example, of a measuring member which measures the surface weight of the base paper before the coating station and a measuring member measuring the surface weight of the coated paper. The quantity applied is obtained by difference measurement. If, upon comparison with a predetermined value for the coating quantity, a deviation above the tolerance set occurs during the coating process, a control device can be caused by impulses to influence the partial vacuum in the chamber 1 so that a correction is automatically obtained in the coating quantity.

The importance of forming a coating with coating composition having high dryness contents and at high web speeds has been previously emphasized. It has been found that the apparatus constructed within the scope of the invention is extremely useful for the purpose. At the same time an extremely satisfactory result with respect to uniformity and quality of coating can be obtained.

When smoothing the applied excess coating composition with a blade and when using coating compositions having high dryness contents, for example over 50% by weight, it has proved necessary to apply the coating composition to the paper web in copious quantities. The removed excess is therefore considerable and the large excess quantity of coating composition will continuously wash the edge of the blade, thus reducing the risk of particles from the paper web or coating composition becoming caught under the edge of the blade. Since the coating composition in the embodiment according to FIG. 1 is applied on the paper web under pressure, the advantage is gained, particularly with high web speeds over 200 m/min, for instance, that a very considerable excess of coating composition can be applied to the web.

However, copious excesses of coating composition entail that the removed excess coating composition, which as described earlier has become thicker, is caused to flow in relatively large quantities and at high speed down along the lower side of the blade and the container walls. Foam is easily formed in this case. According to the invention the removed excess composition is removed separately from the container 1 through the outlet pipe 11 to the container 12.

The partial vacuum established in the conduit 20 maintains a level C in the outlet pipe 11. A considerable variation in the level (between C1 and C2) must be permissible so that the partial vacuum can be varied within wide limits in order to be able to vary the quantity of coating composition in accordance with what has been described previously. A level regulating system 27 is intended to prevent the partial vacuum from being released or the level from rising too high. The level regulating system 28 in the container 12 serves to ensure that a certain quantity of coating composition is always left in the container so that the partial vacuum is not released and at the same time control the outlet from the container 12 so that a suitable quantity of excess coating composition is poured out of the container. Since the container 12 has a very large volume in comparison with the chamber 1 (for reasons of space this is not shown in FIG. 1), the container 12 also serves as a foam separator, i.e. because of the relatively long time the compound remains in the container, a large part of the air entrained in the coating composition when it is scraped off will float up to the surface in the form of foam and can therefore easily be treated with suitable anti-foam agents if desired.

As previously mentioned the removed excess coating composition scraped off by the blade 9 will also contain some impurities in the form of fiber lumps, lumps of pigment and so on. Since according to the invention the removed excess is fed separately from the partially evacuated chamber 1 to an intermediate container 12, from which the excess coating composition is transferred to atmospheric pressure, the excess can be freed from such impurities by screening or the like. This is illustrated by the screen 14 which may be of the so-called open type and provided with a fine screen cloth. Of course other screen arrangements may also be used such as so-called pressure screens, in which case the excess composition is transferred from atmospheric pressure to over pressure by means of a pump, so that the composition is forced through a pressure screen applied on the pressure side of the pump.

Certain factors have been mentioned earlier, which are essential for a successful result when coating compositions with high dryness contents are used and which are significant for the invention. These are the supply of coating composition in copious excess, removing the excess coating composition with adjustable partial vacuum against the edge of a blade and separate return of the excess with simultaneous and subsequent screening and foam treatment to atmospheric pressure and mixing in excess composition thus treated with fresh previously uncirculated coating composition carefully dosed.

Thorough investigations have shown that apart from the factors mentioned above, the distance between the outlet slot 6 and the suction slot 10 is also of importance. The distance should be sufficient to permit the coating composition to be partially absorbed by the paper before the final smoothing takes place. It is difficult to specify any absolute values for this distance since many factors are involved, such as web speed, the nature of the coating composition applied and the excess quantity. However, it has been found that the minimum slot opening 10 is also dependent on certain similar factors. The smallest distance between the lower edge of the outlet slot 6 and the upper edge of the suction slot 10 may therefore be expressed in relation to the size of the slot opening in the direction of movement of the web as a ratio. Experiments have shown that this ratio should not be less than 4:1. Under certain circumstances, however, the ratio should be considerably greater. It has been found that for high-speed coating equipment where not too much composition is applied, the ratio should be at least 30:1. This is because, due to the high speed the impregnation distance must be long, whereas in view of relatively little excess composition the suction slot can be made relatively short. If considerable excess quantities occur in the latter case, a relatively long suction slot must be used, which lowers said ratio to perhaps 15:1. It should be clear from FIG. 1 that this embodiment of the invention permits a relatively large slot distance although a compact coating unit is obtained.

Since the wall section 7 forms a single, substantially straight, coherent surface from the upper edge of the outlet slot 6 to the lower edge of the suction slot 10, smoothing will not occur before the upper edge 9 of the suction slot. This is an advantage since any intermediate smoothing might result in a wave of coating composition being formed which might cause considerable strain on the paper web and the risk of a breakage if the web is of thin paper. For the same reason the edge 22 in FIG. 2 has been bevelled.

Figure 3:
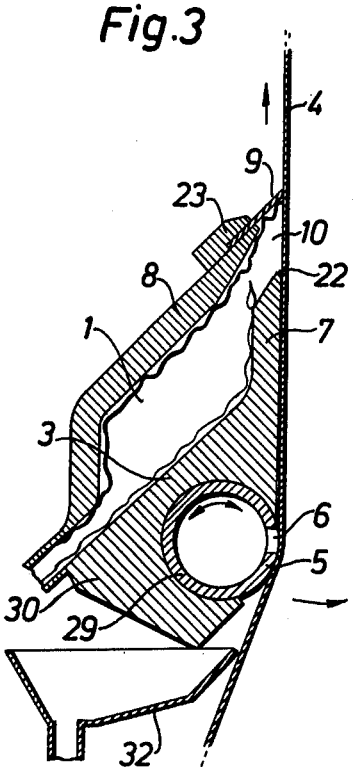
FIG. 3 is a principal view of a second embodiment of the improved coating system of the present invention.
Figure 4:
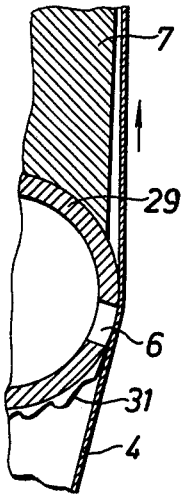
FIGS. 4–6 show different positions of the application means shown in the arrangement according to FIG. 3.
Figure 5:
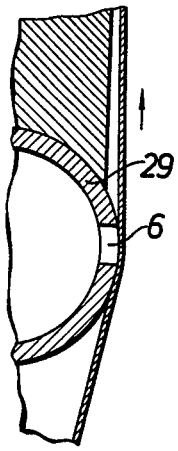
Figure 6:
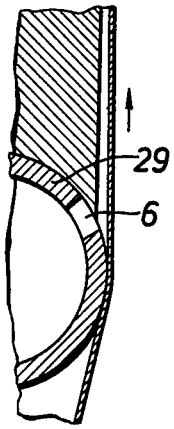

FIG. 3 shows a different embodiment from the one shown in FIGS. 1 and 2. The suction part, which is connected to a vacuum tube, is designed in substantially the same manner, however, and these parts are therefore numbered the same. The outlet parts for the supply of coating composition to the paper web 4 consist here of a pipe 29 with a slot 6. This pipe corresponds substantially to the supply chamber 2 in FIG. 1 and has a communication, not shown in FIG. 3, arranged in a suitable manner, for example in the form of flexible hoses, with a supply pipe for the coating composition. The pipe 29 is pivotably journalled about its longitudinal axis for rotation in a housing 30. The pipe 29 projects slightly from the housing and the paper web 4 surrounds the pipe 29 to a certain extent. By turning the pipe 29 and varying the extent to which the paper web surrounds the pipe, adjustment can be made as desired with respect to the circumstances. A number of different settings are shown in FIGS. 4, 5 and 6. In the setting according to FIG. 4, the slot 6 has been turned slight downwards so that a certain amount 31 of the composition squeezes out through the lower edge of the slot 6 and runs down along the outer surface of the pipe below opening 6. FIG. 3 shows a collection channel 32 for such composition. The setting shown in FIG. 4 has the advantage that a lubricating film is formed between the paper web 4 and the lower edge of the slot 6, thus reducing wear. Furthermore, this insures that air is not drawn in from below due to any unforeseen decrease in the flow of coating composition to the pipe 29.

Figure 7:
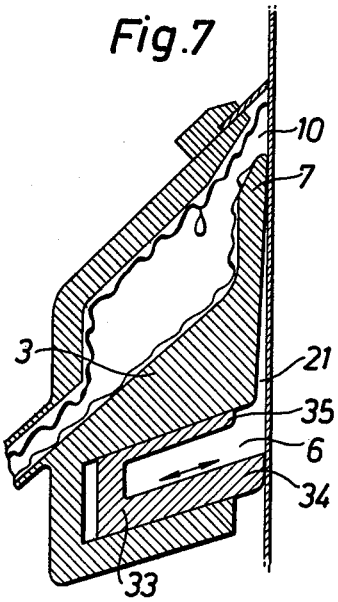
FIG. 7 is a view of a further embodiment of the improved coating system of the present invention.

The setting according to FIGS. 5 and 6 shows how by turning the pipe 29 it is possible to influence and adjust the supply quantity. In the arrangement according to FIG. 7 the supply chamber consists of a U-shaped means 33, the lower leg 34 of which is longer than the upper leg 35. The outlet slot 6 is formed between the two legs. By moving the chamber 33 forwards or backwards the size of the pocket 21 can be varied.

Figure 8:
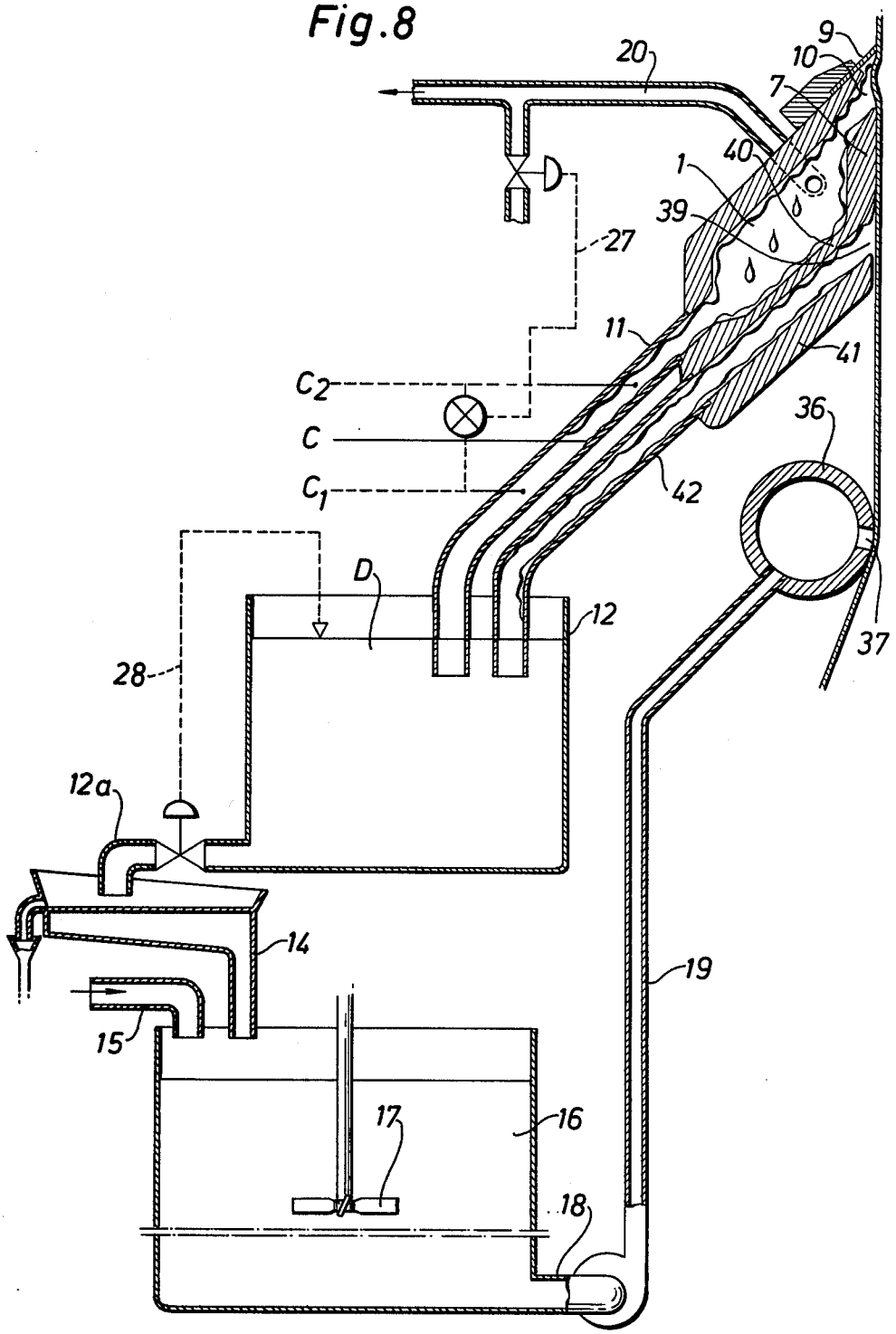
FIG. 8 is a principal view of a further embodiment of the improved coating system of the present invention.

As mentioned earlier, it may in certain cases be desirable to have a very large distance between the point where the coating composition is applied on the paper web 4 and the smoothing point. In such cases it is hardly possible to combine the supply and smoothing in one and the same device as shown in the arrangements according to FIGS. 2–7. In such cases, therefore, the apparatus for supplying the excess of coating composition must be separated from the smoothing apparatus. FIG. 8 shows such an embodiment. The supply for coating composition consists here of a tubular chamber 36 with an outlet slot 37. As in the case of the chamber 29 in FIG. 3, the chamber 36 may be pivotably journalled about its longitudinal axis in order to adjust the position of the slot 37 in relation to the paper web 4. The smoothing means consists of two parts, an upper chamber 1 which is under vacuum and a lower chamber 39 which is in communication with the atmosphere. The upper chamber 1 is constructed in substantially the same manner as chamber 1 in FIG. 1, i.e. it has a substantially vertical wall section 7, a blade 9, an outlet pipe 11 from the lower part of the chamber leading to a container 12 for collecting coating composition scraped off under vacuum. The container 12 has an outlet part 12*a*, opening out over a screen or the like, 14. An inlet for fresh coating composition is designated 15, a storage container 16 having a stirring means 17 and an outlet pipe with pump 18. A supply pipe 19 carries the coating composition under pressure to the chamber 36. The chamber 1 is connected to a vacuum system by way of a conduit 20. Two regulating systems 27 and 28 cooperate to keep the levels C and D within certain limits and pour off a suitable quantity of excess composition, while allowing the level C to fluctuate between the limits C1 and C2, depending on the partial vacuum which has been set with respect to the thickness of coating to be applied, in accordance with the previous explanation.

The lower space 39 is formed by the lower wall 40 of the chamber 1 and a wall 41 located below. A pipe leads from the lower part of the space 39 to the container 12. The walls of the space 39 are used to collect coating composition which will naturally be scraped off the lower part of the wall 7. The coating composition removed in this way can be returned for cleaning via the container 12. It is generally advisable for the removed amount by the wall 7 to be little and the wall section 7 is therefore bevelled at the lower end.

Figure 9:
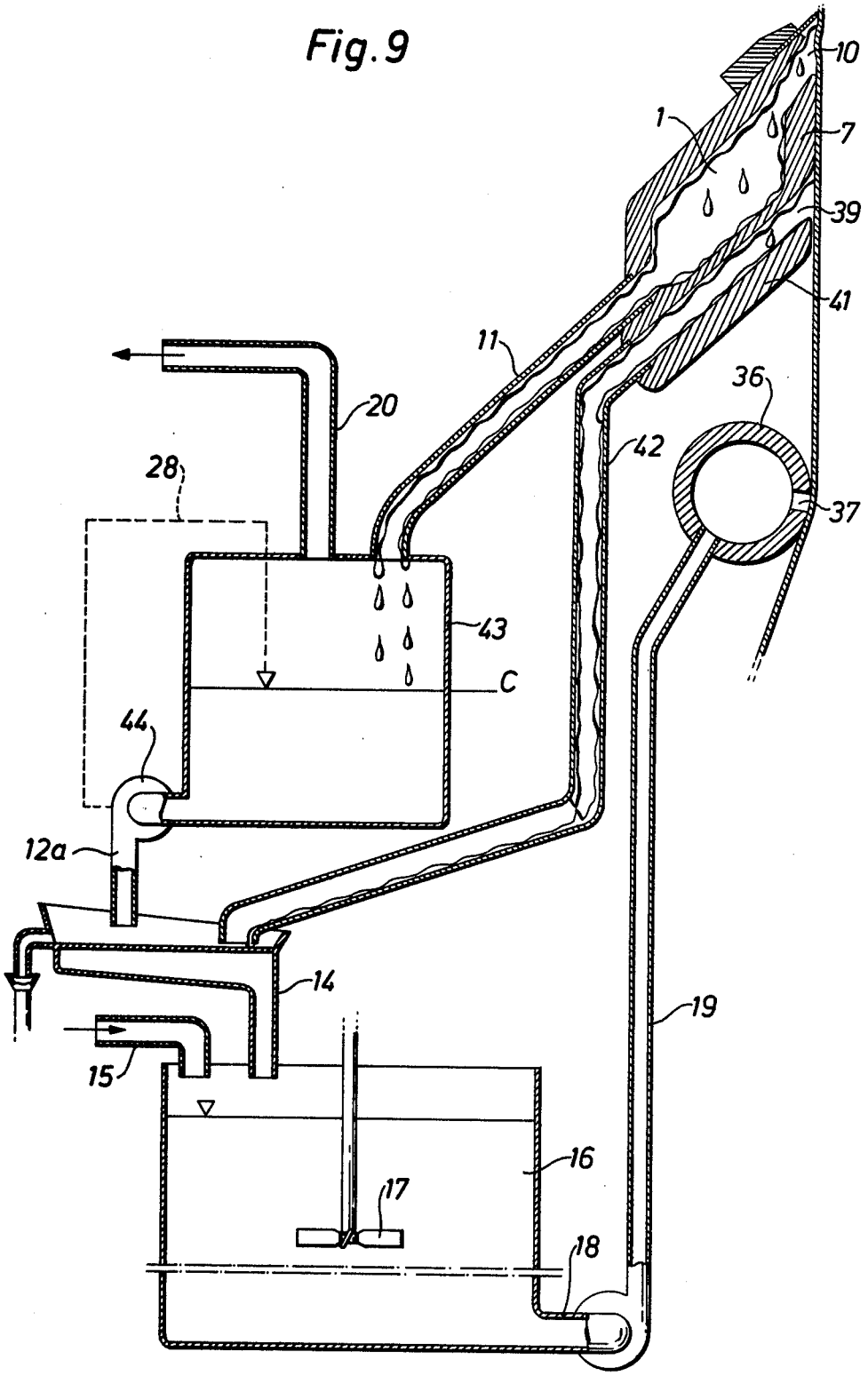
FIG. 9 is a principal view of still another embodiment of the improved coating system of the present invention.

FIG. 9 shows an embodiment similar to that shown in FIG. 8. The difference lies in how the removed excess coating composition is returned to the system via screening and so on. The excess composition from the container 1 which is removed under vacuum is carried via the pipe 11 to a closed container 43 which is in communication with a vacuum system via conduit 20. The level control system 28 operates so that a suitable quantity of composition is tapped off by the pump 44, while maintaining the desired vacuum.

The removed excess composition at 7 is carried through the pipe 42 directly to the screen 14 through which the composition pumped out of the container 43 passes.

It is obvious that the system shown in FIG. 9 for vacuum regulation and tapping off the removed excess composition in the chamber 1 via the closed container 43, the regulating system 28 and pump 44 may be used together with the coating equipment shown in FIG. 1 instead of the system of the rising pipe 11 and open container 12.

As mentioned, the systems described within the scope of the invention for applying a coating composition on a web in excess quantities by means of pressure have certain advantages, when coating with large excess quantities, for instance, which is necessary in certain cases. In other cases, however, it has proved advisable to coat with relatively small excess quantities.

Figure 10:
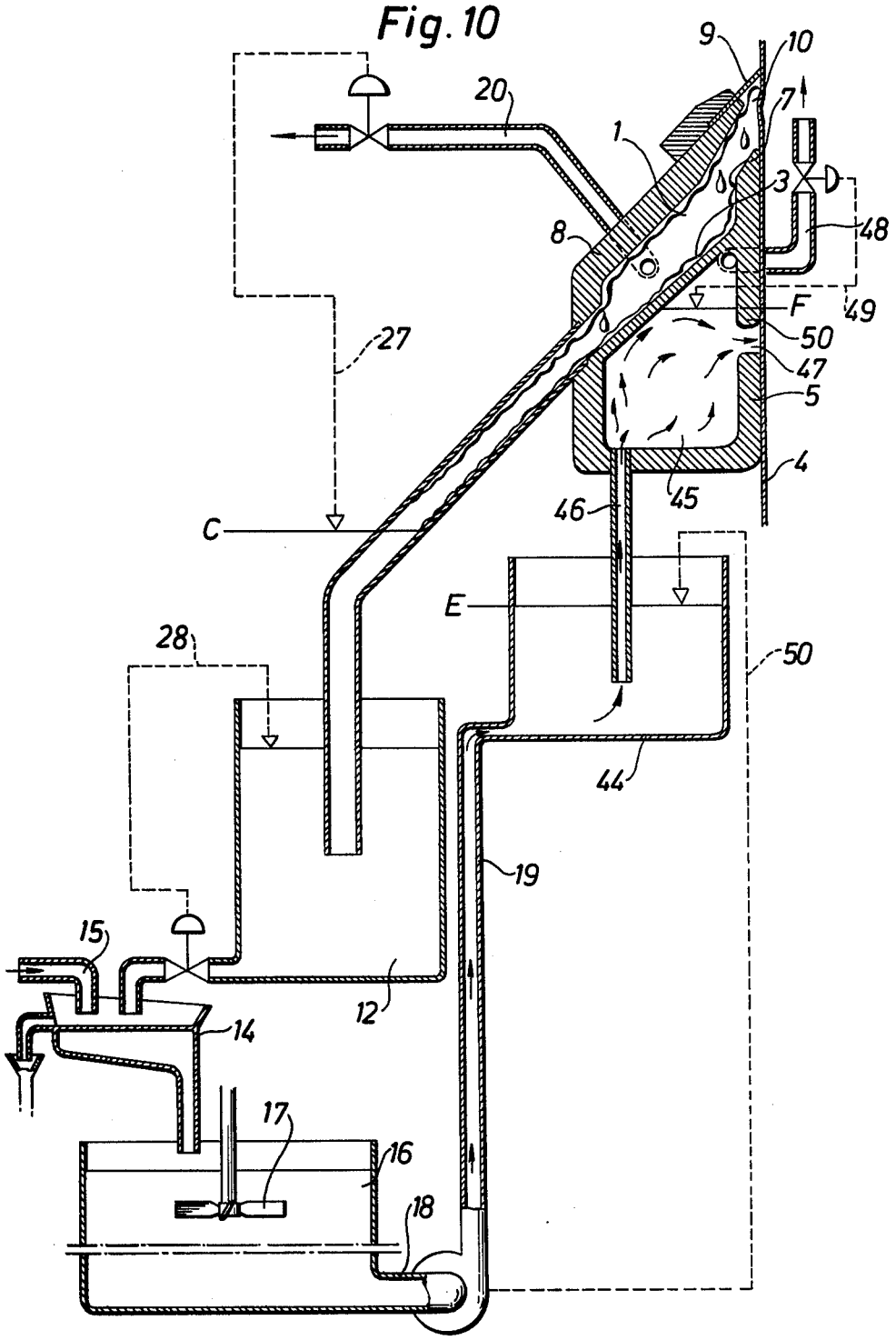
FIG. 10 is a principal view of a further embodiment of the improved coating system of the present invention, which is particularly suitable for providing a coating with a relatively small amount of excess coating composition.

The embodiment shown in FIG. 10 has been found suitable for such purposes. As is clear, the means for removing and smoothing the applied coating composition with relevant vacuum system, level control system, return of the removed composition to the atmosphere, is the same as already shown in FIGS. 1 and 2. These parts have therefore been given the same designations in FIG. 10 as in FIG. 1. However, in the embodiment according to FIG. 10 the coating composition is applied with the assistance of a vacuum. A lower chamber 45 is arranged below the lower, oblique wall 3 of the chamber 1. The chamber 45 is provided with an inlet pipe 46 and an outlet slot 47. A vacuum conduit 48 is connected to the uppr part of the chamber 45. From the pump 18 and via the supply pipe 19, coating composition is supplied from the chamber 1, together with fresh, uncirculated composition, to the intermediate container 44. Regulating equipment 50 ensures that a certain level E is maintained in the container 44. A rising pipe 46 leads from the container 44. By means of a vacuum in the pipe 48, coating composition is drawn up through the rising pipe 46 into the chamber 45 to a level F which is above the upper edge of the outlet slot 47. The level is adjustable and controlled by the regulating system 49.

When the paper web moves upward from below and passes the slot 47, it will take up a certain amount of the coating composition. The quantity is dependent on various factors including the properties of the paper. It has therefore been found advisable in certain cases to bevel the lower edge 50 of the wall 7 inwards. By varying the partial vacuum in the chamber 45, i.e. altering the level, the coating quantity can also be varied to a certain extent.

Figure 11:
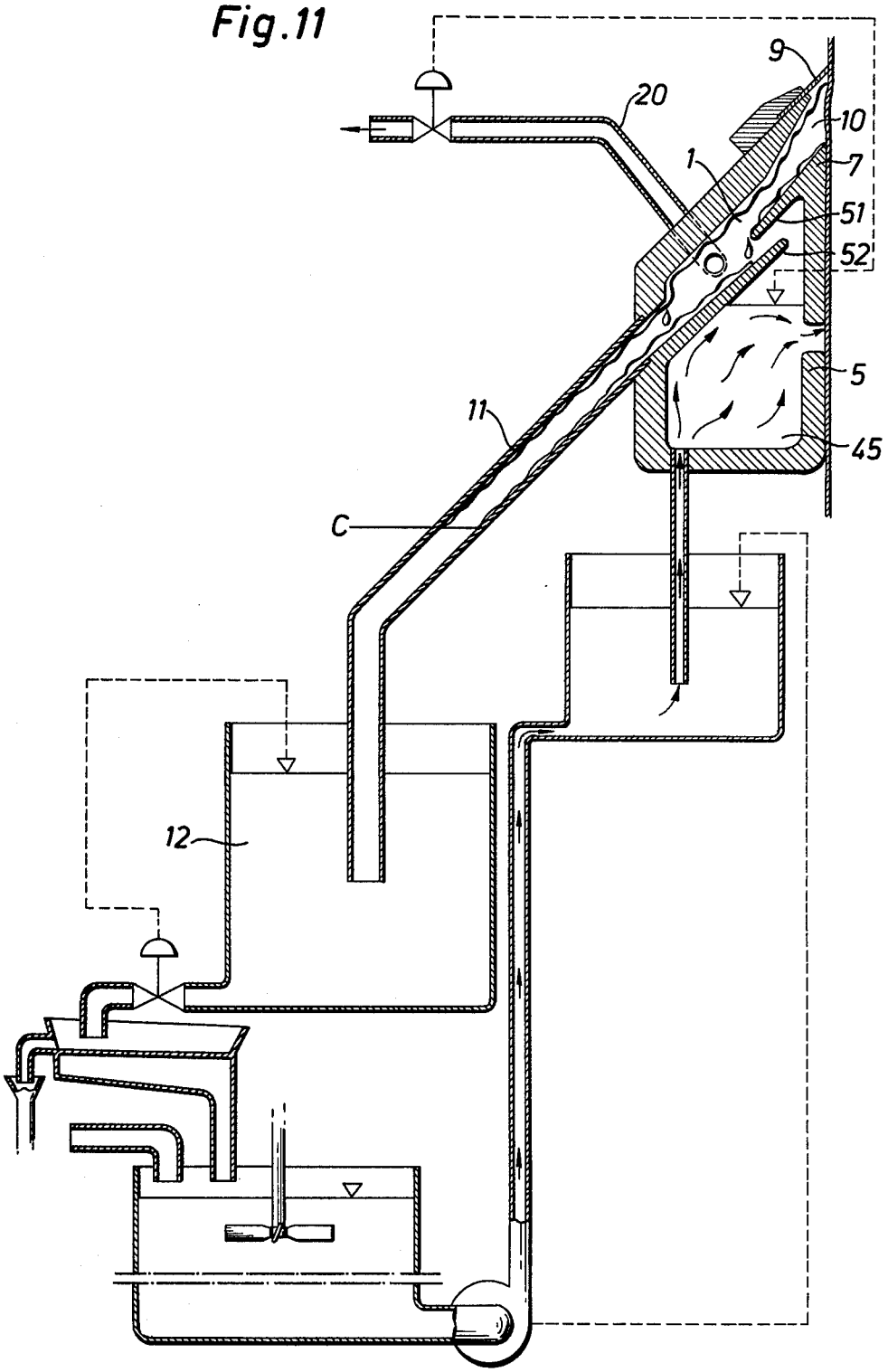
FIG. 11 is a principal view of another embodiment of the improved coating system of the present invention.

According to the arrangement shown in FIG. 11 coating composition is also applied by means of a container under vacuum. The arrangement differs from that shown in FIG. 10 primarily in that partitions between the chamber 1 and chamber 45 are opened by being separated into an oblique upper section 51 and an oblique lower section 52, arranged with the upper section 51 slightly overlapping the lower section 52. The upper part of the chamber 45 thus communicates with the chamber 1. A single vacuum source connected to the vacuum conduit 20 maintains the desired vacuum. The arrangement with the overlapping parts 51 and 52 enables all excess removed composition by the blade 9 to be removed separately and without being mixed with coating composition supplied to the chamber 45, from the coating means via pipe 11 to be returned to atmospheric pressure by way of the intermediate container 12, for instance, for screening and mixing with fresh coating compositions. The means shown in FIG. 11 has certain limitations such as limits to the quantity of excess composition applied and the possibility of varying the coating quantity by means of the vacuum. The advantage is that it is somewhat simpler in construction.

The various means according to the invention have proved particularly suitable in the manufacture of paper which is to be coated on both sides. With the traditional blade-coating described in the introduction, a flexible blade spreads and scrapes off the excess from the applied coating composition. The blade presses against the paper web which is supported by a rotating rubber roller, for instance. When manufacturing paper to be coated on both sides, therefore, the process must be performed in two steps with two coating units, one for each side. In the first coating unit the paper is coated on one side and then dried. After drying, the paper is coated on the other side in a second coating unit and again dried. Such a two step process with an intermediate drying process is necessary since the paper web passes around the rotating rubber roller during coating. If the intermediate drying process is omitted the wet coating layer from the first coating station will be facing the rotating rubber roller in the second coating station and the coating layer will be damaged.

Traditional blade-coating apparatus described above is extremely expensive and complicated. This is primarily because two separate coating stations must be used with intermediate drying.

According to the present invention it is possible to coat a paper web simultaneously on both sides without any intermediate drying process. It is also possible to place two coating units according to the invention very close together so that the equipment for double-sided coating can be made extremely compact and relatively simple. Furthermore, the investment costs for coating equipment for double-sided coating, either directly in the paper machine, or in separate equipment, will be extremely low.

The reason that both sides of the paper can be coated simultaneously is primarily that the coating composition is smoothed and the excess is being removed under vacuum. Thus there is no need for any backing support of the paper web in the form of a roller or the like. The paper web can therefore be passed over a second coating station to coat the side immediately after it has been coated on the first side, without any problems of becoming smeared.

The apparatus according to the invention, in which the coating quantity can be accurately regulated with vacuum, also enables different coating quantities to be applied on the two sides of the paper web if desired. The coating quantity in each coating station can thus be set entirely separately and irrespective of the coating quantity in the other coating station.

In the various embodiments according to FIG. 1 through 11 means have been shown where the paper web is moved vertically upwardly from below. However, vertical web movement is not necessary to obtain a satisfactory coating result. FIGS. 12–19 show some examples of how different coating apparatus within the scope of the invention can be placed in relation to each other for double-sided coating of a paper web.

Figure 12:
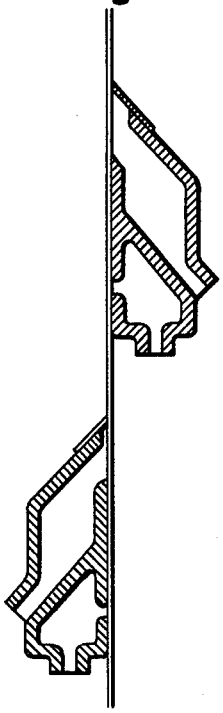
FIGS. 12–19 show different principle embodiments of improved coating systems of the present invention for coating opposite sides of the paper web.
Figure 13:
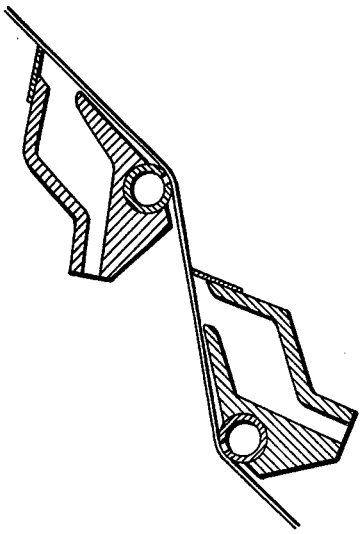
Figure 14:
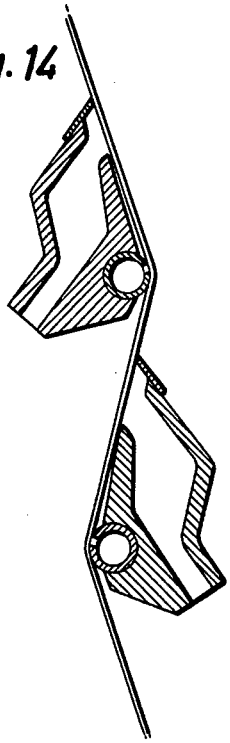
Figure 15:
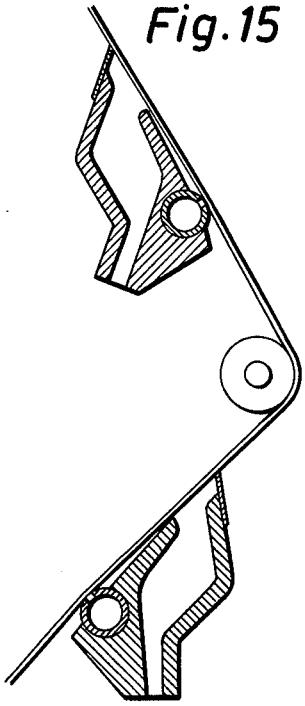
Figure 16:
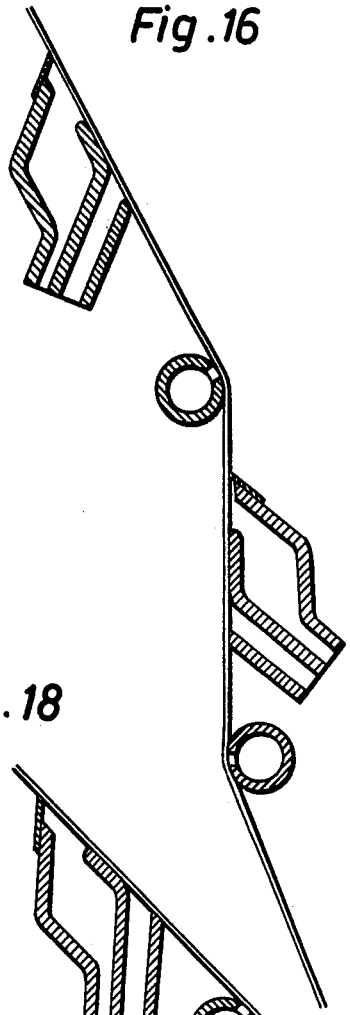
Figure 17:
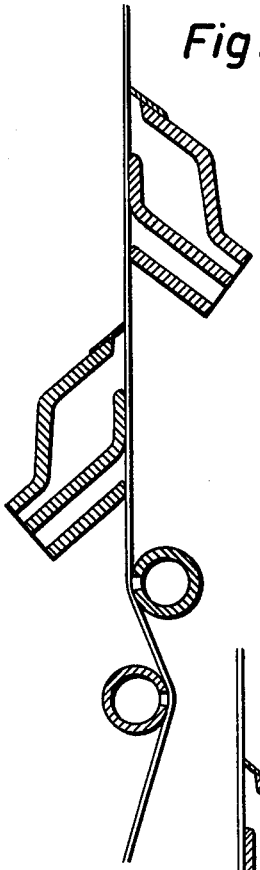
Figure 18:
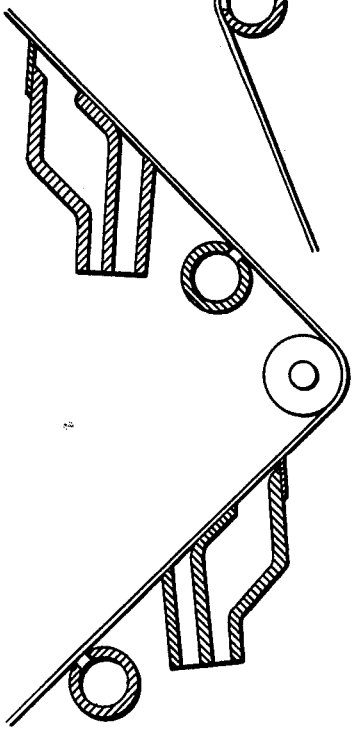

FIGS. 12, 13 and 14 thus show two coating stations most closely resembling the embodiments according to FIGS. 1–7, 10 or 11. FIG. 15 shows how a similar apparatus can be placed, but where the paper web can be deflected in various directions as a guide roller is placed between the two coating stations. FIGS. 16, 17 and 18 show in an equivalent manner to FIGS. 12, 13 and 14, how the coating stations can be placed in relation to each other, but where the means most closely resemble those of FIGS. 8 and 9, i.e. application of the coating composition is performed separately.

Figure 19:
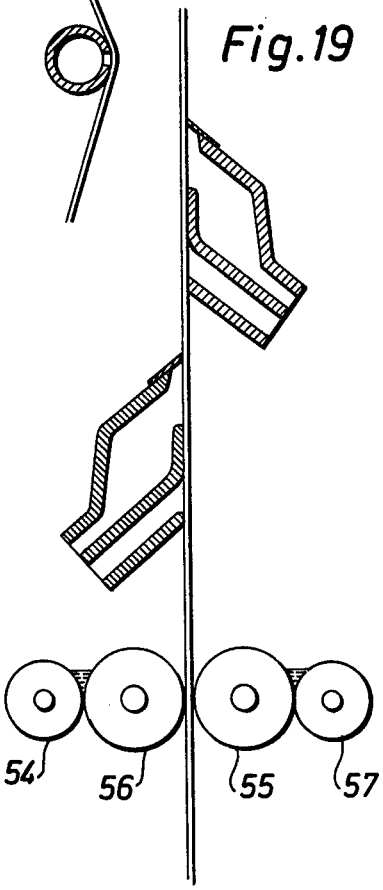

Also included in the scope of the invention are various methods and means for applying an excess of coating composition to the paper web and the apparatus shown are only by way of example. Simultaneous application of the coating composition on both sides is also possible with double-sided coating, after which removing of excess and smoothing is performed separately for the two sides. This is shown in FIG. 19. Two cooperating roller pairs 54, 56 and 55, 57 serve here as supply members for the excess coating composition. Of course many other embodiments are feasible. However, the figure is intended to illustrate that simultaneous application of coating composition before the two individual smoothing stations is also possible.

As previously mentioned, the invention can be used for a wide range of paper qualities. It has been found that by adjusting the coating apparatus according to the invention with respect to the quantity of coating composition applied in relation to the quantity of excess scraped off, vacuum, magnitude of vacuum, distance between application point and suction slot, dryness content of the coating composition and several other essential factors, it is possible to produce a wide range of coating qualities even at high speeds.

It is possible to coat paper with extremely dry coating composition. As an example a dryness content of 60% may be mentioned, but this is obviously not an upper limit. Further, it is also possible to coat with massive excess quantities, which is an advantage in many cases. By way of example it may be mentioned that coating has been performed so that the quantity of composition scraped off at the suction slot has been 12 times the quantity remaining on the paper. However, this does not appear to constitute the highest limit for excess which can be obtained. The magnitude of the vacuum is dependent on several different factors such as the porosity of the paper, speed, excess quantity of the coating composition and final coating thickness desired. With means according to the invention it is possible to work with a very wide range of values with respect to vacuum. An example of a small vacuum is 150 mm water column and an example of a large vacuum is 1100 mm water column, which has been used with coating compositions having high dryness contents and at high operating speeds.

I claim:

1. Apparatus for applying a coating composition to a continuously moving web comprising:

applicator means for applying said coating composition in amounts well in excess of the desired final coating amount;

smoothing means positioned a spaced distance from said applicator means and including a smoothing means housing defining a hollow chamber and a smoothing slot along one side of said housing, said slot being arranged transverse to the direction of movement of the web;

the trailing edge of said slot being formed by a thin flexible blade having a free edge engaging said web for smoothing the coating and removing the excess composition applied to the web, said blade forming an acute angle with the portion of the web moving over said slot;

vacuum means communicating with said hollow chamber and being regulated to draw the web against said slot and thereby control the thickness of the coating applied to the web as well as totally avoiding the need for any backing member for urging the web against the smoothing means slot;

composition removal means communicating with said smoothing chamber for carrying the excess composition out of said chamber;

the excess amount of composition being sufficient to wash solid matter away from the blade and thereby keep the region of the blade smoothing edge free of solid matter;

said applicator means comprising a second housing having a chamber and an elongated applicator slot arranged transverse to the direction of movement of the web whereby the web moves across said applicator slot to receive coating composition prior to smoothing thereof;

the applicator slot and the smoothing slot being separated by a spaced distance, one of said housings having a wall extending between said slots and having an exterior surface facing the moving web and having a length greater than the length of both slots measured in the direction of movement of the web.

2. The apparatus of claim 1 wherein said composition removal means comprises an intermediate container and a conduit having a first end connected to said smoothing means chamber and a second end extending into said container for directing excess composition from said smoothing means chamber into said container;

means for maintaining the surface level of composition in the intermediate container above the second end of said conduit to aid in maintaining a vacuum condition in the smoothing means chamber.

3. The apparatus of claim 2 further comprising means for receiving and filtering composition collected in said intermediate container;

dispensing means including a main container and means for pumping composition therefrom to said dispensing slot;

said receiving and filtering means being arranged to deliver filtered composition into said main container.

4. The apparatus of claim 3 further comprising means for delivering fresh coating composition into said main container;

means in said main container for stirring fresh and filtered coating composition with the present contents of the main container.

5. The apparatus of claim 1 wherein the ends of the exterior surface are beveled inwardly and away from said web to minimize the amount of excess coating composition which might otherwise be removed by said surface thereby assuring that a large quantity of excess coating composition reaches and is removed by said blade smoothing edge.

6. The apparatus of claim 1 wherein the housings of said applicator means and said smoothing means are integrally joined;

the wall forming the exterior surface portion between the applicator and smoothing slots being integrally joined to an interior wall separating the applicator and dispensing chambers.

7. The apparatus of claim 6 wherein said interior wall is provided with an opening for communicating the vacuum condition in the smoothing means chamber to said applicator means chamber.

8. The apparatus of claim 7 wherein said opening in said interior wall is aligned such that coating composition removed from said web by said blade and running downwardly along the surface of the interior wall forming a portion of the smoothing means chamber is prevented from entering into said applicator means chamber through said opening.

9. The apparatus of claim 7 further comprising a container for fresh coating composition and a conduit coupled between the composition in said container and said applicator means chamber whereby the vacuum condition in said applicator means chamber draws the fresh coating composition into said applicator means chamber.

10. The apparatus of claim 1 further comprising a container for holding fresh coating composition and a conduit coupled between said container and the chamber of said applicator means;

means for creating a vacuum condition in said applicator means chamber for drawing coating composition from said container into said applicator means chamber.

11. The apparatus of claim 1, wherein said applicator means and said smoothing means are arranged a spaced distance apart, said smoothing means housing including a lower end extending toward said applicator means; a collection container; said smoothing means housing further including an elongated collection slot for collecting coating composition removed from said web as it passes the collection slot and for depositing said removed composition in said collection container.

12. Apparatus for coating both sides of a continuously moving web by means of first and second coating assemblies arranged at staggered intervals on opposite sides of the web, each of said assemblies being comprised of applicator means for applying said coating composition well in excess of the desired final coating amount;

a smoothing station positioned a spaced distance from said applicator means and including a smoothing station housing defining a hollow chamber and a smoothing slot along one side of said housing arranged transverse to the direction of movement of the web;

the trailing edge of said slot being formed by a thin flexible blade having a free edge engaging one surface of said web for smoothing the coating and removing the excess composition applied to the web, said blade forming an acute angle with the portion of the web moving over said slots;

vacuum means communicating with said hollow chamber and being regulated to draw the web against said slot and to control the thickness of the coating applied to the web as well as totally avoiding the need for any backing member for urging the web against the smoothing slot;

composition removal means communicating with said chamber for carrying the excess composition out of said chambers;

the excess amount of composition being sufficient to wash solid matter away from the blade and thereby keep the region of the blade smoothing edge free of solid matter;

said applicator means comprising a second housing having a chamber and an elongated applicator slot arranged transverse to the direction of movement of the web whereby the web moves across said applicator slot to receive coating composition prior to smoothing thereof;

the applicator slot and the smoothing slot being separated by a spaced distance, one of said housings having a wall whose exterior surface faces the moving web and has a length greater than the length of both slots measured in the direction of the movement of the web.

13. The apparatus of claim 12 wherein said first and second assemblies are positioned at locations intermediate the ends of the web and are arranged to urge the web to follow a zigzag path in the region of said first and second assemblies.

* * * * *